US006569269B1

(12) United States Patent
Fujita et al.

(10) Patent No.: US 6,569,269 B1
(45) Date of Patent: May 27, 2003

(54) PROCESS FOR PRODUCING A HIGH AND LOW PRESSURE INTEGRATED TURBINE ROTOR

(75) Inventors: Akitsugu Fujita, Nagasaki (JP); Masatomo Kamada, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/711,530

(22) Filed: Nov. 14, 2000

(30) Foreign Application Priority Data

Feb. 8, 2000 (JP) ..... 2000-031002

(51) Int. Cl.[7] ..... C21D 9/00

(52) U.S. Cl. ..... 148/639; 416/241 R; 148/644; 148/654

(58) Field of Search ..... 148/335, 654, 148/644, 639, 902; 416/241 R

(56) References Cited

U.S. PATENT DOCUMENTS 5,611,873 A * 3/1997 Yamada et al. ..... 148/335

FOREIGN PATENT DOCUMENTS

| | | |
|---|---|---|
| EP | 0 719 869 | 7/1996 |
| JP | 60-165359 | 8/1985 |
| JP | 62-103345 | 5/1987 |
| JP | 5-195068 | 8/1993 |
| JP | 5-345922 | 12/1993 |
| JP | 6065678 A * | 3/1994 |
| JP | 8-176671 | 7/1996 |
| JP | 409041076 A * | 2/1997 |
| JP | 9-194946 | 7/1997 |

* cited by examiner

*Primary Examiner*—Deborah Yee
(74) *Attorney, Agent, or Firm*—Oblon, Spivak, McClelland, Maier & Neustadt, P.C.

(57) ABSTRACT

In CrMoV based heat resistant steels and tungsten-containing CrMoV based heat resistant steels, trace impurities, such as phosphorus, sulfur, copper, aluminum, arsenic, tin, and antimony are reduced lower than a specific level. Furthermore, alloy steels having increased creep strengths in a creep test on an unnotched test piece by addition of trace impurities such as cobalt, tantalum, nitrogen, boron, or the like is used. The production process therefor includes heating a turbine rotor member having the specific composition at a temperature between 980° C. and 1100° C. at a part corresponding to the high-pressure part thereof and at a temperature between 850° C. and 980° C. at a part corresponding to the low-pressure part thereof, and cooling the turbine rotor member at a cooling rate higher than an air impact cooling rate at the part corresponding to the high-pressure part thereof, and at a cooling rate no lower than an oil quenching rate at the part corresponding to the low-pressure part thereof. The rotor member has a creep rupture time in a creep test on a notched test piece of 10000 hours or longer.

8 Claims, 2 Drawing Sheets

MATERIAL QUENCHED AFTER HEATING AT 900°C
(PRO-EUTECTOID FERRITE: 24% BY VOLUME)
MAGNIFICATION: 400 FOLD (a) MATERIAL QUENCHED AFTER HEATING AT 900°C
(PRO-EUTECTOID FERRITE: 24% BY VOLUME)
MAGNIFICATION: 400 FOLD (b) MATERIAL QUENCHED AFTER HEATING AT 950°C
(PRO-EUTECTOID FERRITE: 12% BY VOLUME)
MAGNIFICATION: 400 FOLD (c) MATERIAL QUENCHED AFTER HEATING AT 1,000°C
(PRO-EUTECTOID FERRITE: 4% BY VOLUME)
MAGNIFICATION: 400 FOLD (d) MATERIAL QUENCHED AFTER HEATING AT 1,050°C
(PRO-EUTECTOID FERRITE: 0% BY VOLUME)
MAGNIFICATION: 400 FOLD

PROCESS FOR PRODUCING A HIGH AND LOW PRESSURE INTEGRATED TURBINE ROTOR

BACKGROUND OF THE INVENTION

1. Field of the Invention

The present invention relates to turbine rotors and in particular it relates to high pressure and low pressure integrated type turbine rotors used in steam turbines employed in thermal electric power generation.

2. Description of Related Art Including Information Disclosed Under 37 CFR 1.97 and 37 CFR 1.98

Conventionally, as one type of turbine rotor for steam turbines for thermal electric power generation, high pressure and low pressure integrated turbine rotors utilizing integrated materials from the high pressure part to the low-pressure part have been known. The steam turbine is exposed to high-temperature and high-pressure steam on the side of its steam inlet. As the end portion is being approached, the temperature and pressure of steam decrease, so that the steam turbine is exposed to steam that has a highly expanded volume. Therefore, in the high-pressure part, the turbine blades are short in length and the stress applied to the turbine rotor is relatively small, and thus the diameter of the turbine rotor may be small. On the other hand, in the low pressure part, to receive the force exerted by a larger amount of steam, the length of the turbine blades must be large and the diameter of the turbine rotor must be large, resulting in a large stress being applied to the turbine rotor. Therefore, the characteristics required for the high pressure and low pressure integrated type rotors are high temperature strength, in particular excellent creep strength at the high-pressure part, and on the other hand, at the low pressure part, mechanical strength and excellent toughness at ordinary temperature.

Conventionally, as examples of heat-resistant steels for use in high pressure and low pressure integrated type turbine rotors, CrMoV steels, which belong to low-alloys, and 12Cr steels, which belong to high-Cr steels, have been exclusively used (see Japanese Patent Applications, First Publications (Kokai), Nos. Sho 60-165359 and Sho 62-103345). A process for obtaining a turbine rotor having creep properties and toughness simultaneously has been proposed, in which a CrMoV based steel species is processed into a turbine rotor member and the high-pressure and low-pressure parts of a single turbine rotor are separately heat treated under different conditions. For example, Japanese Patent Application, First Publication (Kokai), No. Hei 5-195068 discloses a process for obtaining a high pressure and low pressure integrated type turbine rotor having creep strength at high temperatures and toughness simultaneously, in which the high pressure part of a rotor member is quenched after heating at a temperature higher than the low pressure part and then the whole rotor member is tempered at a predetermined temperature. Japanese Patent Application, First Publication (Kokai) No. Hei 8-176671 discloses a process for obtaining a high pressure and low pressure integrated turbine rotor having excellent creep properties at high temperatures and toughness simultaneously, in which a rotor member is normalizing-treated at 1100 to 1150° C. and pearlite-transformed, further normalizing-treated at 920 to 950° C., the high pressure part and low pressure part are quenched at different temperatures, and then the whole rotor member is tempered.

However, in recent years, further improvement in the energy efficiency has been desired, and there has been a trend that the temperature and the amount of steam introduced into turbines is increased, resulting in much stricter characteristics being required for turbine rotors. Therefore, rotors of a conventional type are insufficient in mechanical properties at high temperatures, particularly in terms of creep strength, at their high-pressure parts. Accordingly, the need for developing a material that is durable in use at higher steam temperatures has been growing. On the other hand, for low-pressure parts, developing a material that is durable to stronger stresses and has increased toughness has become necessary.

Conventionally, a CrMoV steel is used after quenching the CrMoV steel heated to a temperature of about 950° C. A higher heating temperature before quenching results in a higher strength of the material because precipitation of a pro-eutectoid ferrite phase, which is soft, is inhibited, and dissolution of the strengthening elements in a solid solution is promoted. However, another problem arises in that a higher heating temperature before quenching causes creep embrittlement of the material. Therefore, the heating temperature before quenching cannot be raised. Although attempts have been made in which various alloy elements were additionally used and heat treatments have been devised in order to inhibit the creep embrittlement, a satisfactory material has not yet been obtained.

A higher temperature before quenching causes a problem that coarsening of crystal grains is promoted and thus the toughness of the material deteriorates. In view of this, the temperature before quenching could not be elevated to 1000° C. or more. Thus, to satisfy the high temperature strength and brittleness of a CrMoV steel simultaneously involves the difficulty that inconsistent heat treatment conditions are used in the production of the steel. As a result, no satisfactory turbine rotor suitable for large volume steam turbines for use at high temperatures has been obtained.

BRIEF SUMMARY OF THE INVENTION

Accordingly, an object of the present invention is to provide a heat-resistant steel which can be quenched after heating to a higher temperature, has a toughness equivalent to or higher than that of a conventional CrMoV steel, and has excellent creep properties at high temperature such as a high creep rupture property, according to a creep test on an unnotched test piece, and inhibition of creep embrittlement. Another object of the present invention is to provide a turbine rotor comprising this novel heat-resistant steel.

In order to achieve the above objects, the present inventors have diligently carried out research, and found that impurities greatly affect the properties of a steel at high temperatures, particularly the creep embrittlement resistance. As a result, the present inventors found that a high pressure and low pressure integrated type turbine rotor which can be quenched after heating to a high temperature between 980° C. and 1100° C., and having excellent creep strength at its high pressure part, such as not being subject to creep embrittlement, and a high toughness at its low pressure part can be obtained not only by mixing alloy components with predetermined proportions, but also by minimizing the amount of trace impurity elements which are harmful, such as phosphorus, sulfur, copper, aluminum, arsenic, tin, and antimony. The present inventors have thus achieved the present invention.

The high-pressure part of the high pressure and low pressure integrated type turbine rotor has excellent high temperature properties with a creep rupture time of 3000 hours or longer, according to a creep test on an unnotched test piece, under specific conditions of a temperature of 600° C. and a stress of 147 MPa, and a creep rupture time of 10000 hours or longer, according to a creep test on a notched test piece, under the same conditions as described above. The low-pressure part of the high pressure and low pressure integrated type turbine rotor has an excellent toughness of 0.2% yield strength of 686 MPa or more, and Charpy impact absorbed energy of 98 J or more. The high pressure and low pressure integrated type turbine rotor of the present invention has excellent creep properties at the high-pressure part and excellent toughness at the low-pressure part simultaneously.

The process for producing a high pressure and low pressure integrated type turbine rotor of the present invention is a method in which a rotor member made of an alloy steel having a specific composition is subjected to different heat treatments at its high pressure and low pressure parts, respectively. More particularly, the high pressure and low pressure integrated type turbine rotor of the present invention can be obtained by providing a rotor member made of an alloy steel having a specific composition, quenching the part corresponding to the high-pressure part of the rotor member after heating at a temperature of 980° C. or more and 1100° C. or less, cooling it at a higher cooling rate not lower than the air impact cooling rate while heating the part corresponding to the low-pressure part of the rotor member at a temperature of 850° C. or more and less than 980° C., and cooling it at a lower cooling rate not lower than the oil cooling rate. Thus, the part corresponding to the high-pressure part of the rotor member is quenched after heating to a high temperature and tempering it at a high temperature, while the part corresponding to the low-pressure part of the rotor member is quenched after heating to a relatively low temperature and tempering it at a relatively low temperature. Use of different heat treatments between the high-pressure and low-pressure parts can make the high-pressure part have excellent high temperature properties of a creep rupture time of 10000 hours or longer, according to a creep test on a notched test piece, under specific conditions of a temperature of 600° C. and a stress of 147 MPa, and the low-pressure part have excellent toughness of Charpy impact absorbed energy of 98 J or more.

The specific alloy steel composition which can exhibit such excellent properties as above will be described in detail hereinbelow, but briefly it is characterized by allowances of contents of impurity elements such as phosphorus, sulfur, copper, aluminum, arsenic, tin, and antimony, which could affect adversely the embrittlement resistance at high temperatures of CrMoV based heat resistant steels and CrMoV based heat resistant steels containing tungsten, being limited to predetermined values or less.

First, of the high-temperature properties, the creep rupture strength of a notched test piece will be described. When a stress is applied to a steel product at a high temperature, even if the stress is comparatively small, the steel product plastically deforms very gradually to become elongated, and finally the elongation proceeds rapidly narrowing a part of the steel product, which results in rupture in the steel product. This phenomenon is called "creep" or "creep rupture phenomenon". This phenomenon is believed to occur due to viscous flow at crystal grain boundaries and dislocation within crystals. In a high-temperature creep test, a constant static load is applied to a material for a long time at a high temperature, and the time elapsed before rupture is measured. As a test piece, a round bar having a constant cross section is used. The measuring method is defined by JIS Z-2272. The measuring methods defined by the JIS standards are for creep tests on unnotched test pieces, and test pieces which are finished by smoothly shaving between gauge marks in the portion to be measured are used in these methods.

In contrast, in a creep test on a notched test piece, a test piece having a notch between gauge marks is used. The cross section of the portion to be stretched and subject to measurement is set to be the same as the cross section of the part subject to the measurement in a creep test on an unnotched test piece, and the stress is determined. The diameter of the parallel part of the test piece (corresponding to the portion between gauge marks) is set to 1.2 times the diameter of the bottom of the notch, and the notch is formed so that it has an opening angle of 60° and a radius of curvature of 0.13 mm at the bottom of notch, and is cut perpendicularly to the direction of drawing. In a creep test on an unnotched test piece, a tensile stress which is applied gradually elongates the distance between gauge marks, and narrows the portion between the gauge marks, which finally will rupture. In contrast, if a notch is formed in a test piece, a stress which counteracts deformation of the notched portion is produced such that the stress surrounds the notched portion (this stress is a so-called "multiaxial stress"), and the test piece finally ruptures without being uniformly elongated. In general, with a highly ductile material, the lapse of time before rupture tends to be longer than that of the creep test on the unnotched test piece because deformation is restricted by the notch. However, depending on the type of steel, embrittlement of some materials gradually advances during the creep rupture tests, and a creep rupture may occur due to the occurrence of voids or the formation of cracks from connected voids. In this case, a notched test piece ruptures in a shorter time than an unnotched test piece due to the concentrated stress. Such a phenomenon is called "notch softening", which can be used as an index for expressing creep embrittlement. That is to say, by conducting creep rupture tests on an unnotched test piece and a notched test piece under the same conditions such as stress and temperature, and comparing the times elapsed before creep rupture, the level of creep embrittlement can be clearly demonstrated.

Since a turbine rotor is subjected to high temperatures for a long period of time under stress during its operation, deterioration in the strength of the material with age is of concern. The quality of turbine rotor members has been hitherto evaluated only by high-temperature creep tests on unnotched test pieces, as defined by the Japanese Industrial Standards or the like. However, the present inventors have found a method of evaluating high-temperature strength properties of the material, particularly the creep embrittlement resistance, in a high-temperature creep test on a notched test piece. In addition, the present inventors have found that trace impurity elements which are harmful and greatly affect creep embrittlement. As a result, the present inventors succeeded in developing a material which can be quenched after heating to a high temperature of approximately 1000° C. or more, which is inhibited from producing precipitation of a pro-eutectoid ferrite phase, and which is not subject to creep embrittlement, by minimizing the amount of trace impurity elements which are harmful, such as phosphorus, sulfur, copper, aluminum, arsenic, tin, and antimony.

Since the rotor is made of a CrMoV based heat resistant steel containing minimized amounts of harmful trace impurity elements and CrMoV based heat resistant steels containing tungsten, when the part corresponding to its high-pressure part is quenched after heating at a higher temperature of 980° C. or more and 1100° C. or less and tempered at a cooling rate not lower than the air impact cooling rate, excellent creep embrittlement resistance can be obtained. On the other hand, when the part corresponding to its low-pressure part is quenched after heating at a lower temperature of 850° C. or more and less than 980° C., and cooling it at a lower cooling rate not lower than the oil cooling rate, excellent toughness can be obtained.

That is to say, an alloy according to the first aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, vanadium in an amount of 0.1 to 0.3% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

By limiting the permissible amounts of phosphorus, sulfur, copper, aluminum, arsenic, tin, and antimony impurities, which are harmful in causing creep embrittlement in conventional CrMoV steels, to low levels, the creep embrittlement resistance is particularly improved.

An alloy according to the second aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, phosphorus in an amount not larger than 0.012% by weight or substantially no phosphorus, sulfur in an amount not larger than 0.005% by weight or substantially no sulfur, copper in an amount not larger than 0.10% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

Tungsten is added to the alloy according to the first aspect with the intention of improving particularly the creep rupture strength at the high-pressure part. Furthermore, as in the alloy according to the first aspect, by limiting the permissible amounts of phosphorus, sulfur, copper, aluminum, arsenic, tin, and antimony impurities, which are harmful in causing creep embrittlement, to low levels, the creep embrittlement resistance is particularly improved. Here, when importance is laid on the improvement in the creep rupture strength at the high-pressure part, the content of tungsten may be made larger to some extent while importance is laid on the improvement in toughness at the low-pressure part, the content of tungsten may be made smaller to some extent.

An alloy according to the third aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, vanadium in an amount of 0.1 to 0.3% by weight, cobalt in an amount of 0.1 to 3.0% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

Cobalt is added to a conventional CrMoV steel with the intention of improving the creep rupture strength at the high-pressure part and the toughness at the low-pressure part. Furthermore, by limiting the permissible amounts of phosphorus, sulfur, copper, aluminum. arsenic, tin, and antimony impurities, which are harmful in causing creep embrittlement, to low levels, the creep embrittlement resistance is particularly improved.

An alloy according to the fourth aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, cobalt in an amount of 0.1 to 3.0% by weight, phosphorus in an amount not larger than 0.012% by weight or substantially no phosphorus, sulfur in an amount not larger than 0.005% by weight or substantially no sulfur, copper in an amount not larger than 0.015% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

Tungsten and cobalt are added to a conventional CrMoV steel with the intention of improving the creep rupture strength at the high-pressure part and the toughness at the low-pressure part. Furthermore, by limiting the permissible amounts of phosphorus, sulfur, copper, aluminum, arsenic, tin, and antimony impurities, which are harmful in causing creep embrittlement, to low levels, the creep embrittlement resistance is particularly improved.

An alloy according to the fifth aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, vanadium in an amount of 0.1 to 0.3% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

This alloy is intended to further improve the creep properties on an unnotched test piece with a view to increasing particularly the creep rupture strength at the high-pressure part by the addition of at least one of trace elements selected from tantalum, nitrogen, and boron to the alloy according to the first aspect. Furthermore, as in the alloy according to the first aspect, by limiting the permissible amounts of phosphorus, sulfur, copper, aluminum, arsenic, tin, and antimony impurities, which are harmful in causing creep embrittlement, to low levels, the creep embrittlement resistance is particularly improved.

An alloy according to the sixth aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an a mount not larger than 0.003% by weight or substantially no antimony, the balance being iron and unavoidable impurities.

This alloy is intended to further improve the creep properties on an unnotched test piece with a view to increasing particularly the creep rupture strength at the high-pressure part by the addition of at least one of trace elements selected from tantalum, nitrogen, and boron to the alloy according to the second aspect.

An alloy according to the seventh aspect of the present invention is a low-alloy heat-resistant steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, cobalt in an amount of 0.1 to 3.0% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.015% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

This alloy is intended to further improve the creep properties on an unnotched test piece with a view to increasing particularly the creep rupture strength at the high-pressure part by the addition of at least one of trace elements selected from tantalum, nitrogen, and boron to the alloy according to the fourth aspect.

The high pressure and low pressure integrated type turbine rotor of the present invention has high temperature creep properties, and particularly exhibits excellent creep properties on a notched test piece and excellent toughness simultaneously. The high-pressure part of the high pressure and low pressure integrated type turbine rotor has excellent high temperature properties with a creep rupture time of 3000 hours or longer, according to a creep test on an unnotched test piece, under specific conditions of a temperature of 600° C. and a stress of 147 MPa, and a creep rupture time of 10000 hours or longer, according to a creep test on a notched test piece, under the same conditions as described above. The low-pressure part of the high pressure and low pressure integrated type turbine rotor has an excellent toughness of 0.2% yield strength of 686 MPa or more, and Charpy impact absorbed energy of 98 J or more. The high pressure and low pressure integrated type turbine rotor of the present invention has a creep embrittlement index of 1.6 or more, preferably 2.0 or more, and more preferably 3.0 or more, wherein the index is defined by a ratio of a creep rupture time in a creep rupture test on a notched test piece to a creep rupture time in a creep rupture test on an unnotched test piece.

The high temperature creep property is judged by the length of creep time on an unnotched test piece and in addition by the creep embrittlement index in order not to cause creep embrittlement. To cause no creep embrittlement, a creep embrittlement index of 1.5 is unsatisfactory and at least 1.6 is necessary. The turbine rotor having a creep rupture time exceeding 10000 hours has a creep embrittlement index exceeding 1.6 and even a turbine rotor having a creep embrittlement index exceeding 3.0 can also be realized.

As explained above, a high pressure and low pressure integrated type turbine rotor having an excellent creep rupture strength and an excellent toughness has been provided by the present invention for the first time.

Further, the process for producing a high pressure and low pressure integrated type turbine rotor according to the present invention is to heat a turbine rotor member made of each alloy steel containing the above specific components at a temperature of 980° C. or more and 1100° C. or less at a part corresponding to the high-pressure part of the turbine rotor member, cooling it at a cooling rate higher than the air impact rate while heating the part corresponding to the low-pressure part of the turbine rotor member at 850° C. or more and less than 980° C., and cooling it at a cooling rate higher than oil quenching rate.

The heating of the part corresponding to the high-pressure part of a turbine rotor at high temperatures is intended to have the alloy elements dissolved in the alloy matrix sufficiently and make crystal grains relatively coarse to impart high temperature strength thereto. On the other hand, the heating of the part corresponding to the low-pressure part of a turbine rotor at temperatures lower than the temperature of the high-pressure part is intended to make the crystal grains finer in order to increase toughness.

The high pressure and low pressure integrated type turbine rotor of the present invention has excellent high temperature strength and excellent creep rupture strength at its high-pressure part and excellent mechanical strength and toughness at its low-pressure part simultaneously so that it can be used at higher temperatures in a large volume steam turbine, thus enabling realization of an electric power plant having a high energy efficiency and being extremely useful.

According to the process for producing a high pressure and low pressure integrated type turbine rotor of the present invention, a turbine rotor that is free of creep embrittlement even when it is quenched after being heated at a high temperature in the range of 980° C. or more and 1,100° C. or less at its high-pressure part can be obtained easily by minimizing the contents of harmful impurity elements.

Also, a turbine rotor can be obtained easily which is excellent in 0.2% yield strength and has a high Charpy impact value and excellent toughness at its low-pressure part.

DETAILED DESCRIPTION OF THE INVENTION

Figure 1:
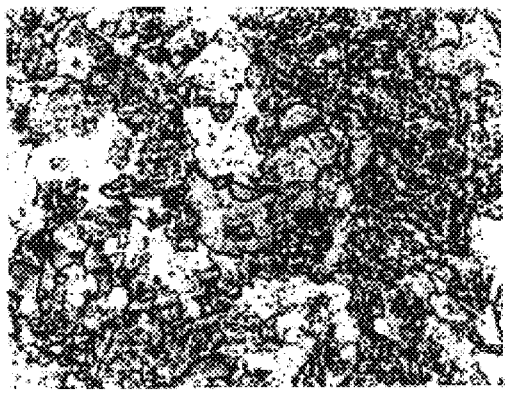
FIG. 1 is a diagram showing the structure observed using an optical microscope of an example of an alloy of the present invention when quenched after heated at 900° C.

In the following, the reason for limiting the amount of each component in the alloy of the first aspect of the invention is described. The amounts of the components are expressed hereinafter on the basis of weight percentages, unless otherwise specified.

Carbon (C): Carbon has the effect of increasing the material strength as well as ensuring the hardenability during the heat treatment. In addition, carbon forms a carbide and contributes to the improvement of the creep rupture strength at high temperatures. In the alloys according to the present invention, the lower limit of the carbon content is 0.20%, since a carbon content of less than 0.02% does not impart sufficient material strength to the alloy. On the other hand, an excessive carbon content causes a deterioration of the toughness, and while the alloy is being used at a high temperature, carbide and/or nitride aggregates to form coarse grains, which cause degradation in the creep rupture strength and creep embrittlement. Accordingly, the upper limit of the carbon content is 0.35%. A particularly preferred range within which both material strength and the toughness are imparted to the alloy is from 0.22 to 0.30%.

Silicon (Si): While Si is an element which is effective as a deoxidizer, it embrittles the alloy matrix. Silicon is introduced from raw materials for the production of steel, and a careful selection of materials is necessary to achieve an extreme reduction of silicon, which results in a higher cost. Therefore, the upper limit of the silicon content is 0.15%. A preferable range is 0.10% or less.

Manganese (Mn): Manganese functions as a deoxidizer as well as having the effect of preventing hot cracks during forging. In addition, manganese has the effect of enhancing the hardenability during heat treatment. However, since too large a manganese content causes a deterioration of the creep rupture strength, the upper limit of the manganese content is 1.0%. However, since limiting the manganese content to less than 0.05% requires careful selection of materials and excessive refining steps, and therefore brings about a higher cost, the lower limit of the manganese content is 0.05%. Accordingly, the range of the manganese content is from 0.05 to 1.0%, preferably from 0.15 to 0.9%.

Nickel (Ni): Nickel particularly has the effect of enhancing the toughness as well as enhancing the hardenability during the heat treatment and improving the tensile strength and the yield strength. If the nickel content is less than 0.3%, these effects are not discernible. On the other hand, a large amount of nickel added reduces the long-term creep rupture strength. For the alloy of the present invention, the addition of nickel cannot be relied on for improvement of the hardenability, the toughness, and the like, so instead the upper limit of the nickel content is 2.5% in order to eliminate the harmful effect of nickel on the long-term creep rupture strength. Taking account of the balance between this harmful effect and the effect of enhancing the toughness when tungsten is not used, the range of the nickel content is from 0.3 to 1.5%, preferably from 0.5 to 0.9%.

Chromium (Cr): Chromium enhances the hardenability of the alloy during the heat treatment as well as contributing to improvement of the creep rupture strength by forming a carbide and/or a nitride, and improving the antioxidation effect by dissolving in the matrix of the alloy. In addition, chromium has the effect of strengthening the matrix itself and improving the creep rupture strength. A chromium content of less than 1.0% does not provide a sufficient effect, and a chromium content exceeding 3.0% has the adverse effect of reducing the creep rupture strength. Accordingly, the range of the chromium content is from 1.0 to 3.0%, preferably from 2.0 to 2.5%.

Molybdenum (Mo): Molybdenum enhances the hardenability of the alloy during the heat treatment as well as improving the creep rupture strength by dissolving in the matrix of the alloy or in a carbide and/or a carbonitride. If the molybdenum content is less than 0.5%, these effects are not sufficiently discernible. The addition of molybdenum exceeding 1.5% has the adverse effect of causing the deterioration of toughness, and brings about a higher cost. Accordingly, the molybdenum content is from 0.1 to 1.5%, preferably 0.9 to 1.3%.

Vanadium (V): Vanadium enhances the hardenability of the alloy during the heat treatment as well as improving the creep rupture strength by forming a carbide and/or a carbonitride. A vanadium content of less than 0.1% does not provide a sufficient effect. In addition, a vanadium content exceeding 0.3% has the opposite effect of causing deterioration of the creep rupture strength. Accordingly, the vanadium content is from 0.1 to 0.3%, preferably from 0.21 to 0.28%.

Tungsten (W): Tungsten dissolves in the matrix of the alloy or a carbide to improve the creep rupture strength. If the tungsten content is less than 0.1%, the above effect is not sufficient. If the tungsten content exceeds 3.0%, there is a possibility of segregation in the alloy, and a ferrite phase tends to emerge, which causes a deterioration of the strength. Accordingly, the tungsten content is suitably from 0.1 to 3.0%. When tungsten is used in order to improve the creep rupture strength, the amount of nickel to be added must be increased in order to prevent a decrease in hardenability and toughness due to the addition of tungsten. Therefore, the content of tungsten is 0.1 to 3.0% and the content of nickel is 0.3 to 2.5%. When toughness is important, it is preferred that the content of tungsten be 2% or less and the content of nickel be 1.0% or more. When high temperature creep properties is important, it is preferred that the content of tungsten be 2% or more and the content of nickel be 1.0% or less.

Cobalt (Co): Cobalt dissolves in the matrix of the alloy, and strengthens the matrix itself as well as inhibiting the precipitation of the ferrite phase. In addition, cobalt has the effect of improving the toughness, and thus is effective in maintaining the balance between the strength and the toughness. If the amount of cobalt added is less than 0.1%, the above effects are not discernible. If the amount of cobalt added exceeds 3.0%, precipitation of carbides is accelerated, which leads to deterioration of the creep properties. Accordingly, a permissible range of the cobalt content is from 0.1 to 3.0%, and more preferably from 0.5to 2.0%.

Tantalum (Ta): Tantalum, in a manner similar to niobium, enhances the hardenability of the alloy as well as improves the creep rupture strength by forming a carbide and/or a carbonitride. If the amount of tantalum added is less than 0.01%, the effects are not discernible. An amount of tantalum added exceeding 0.15% would bring about a noticeable deterioration of the toughness as well as causing formation of coarse grains of the carbide or the carbonitride of tantalum during use of the alloy, which causes a deterioration of the long-term creep rupture strength. Accordingly, it has been determined that a permissible tantalum content is from 0.01 to 0.15%, preferably 0.05 to 0.1%.

Nitrogen (N): Nitrogen together with carbon is bonded to alloy elements and forms carbonitrides, which contribute to the improvement of the creep rupture strength. If the amount of nitrogen added is less than 0.001%, nitrides cannot be formed, and thus the above effects are not discernible. If the amount of nitrogen added exceeds 0.05%, carbonitrides are aggregated to form coarse grains, and thus a sufficient creep strength cannot be obtained. Accordingly, it has been determined that a permissible nitrogen content is from 0.001 to 0.05%, preferably 0.005 to 0.01%.

Boron. (B): Boron enhances the hardenability as well as contributing to improvement of the creep rupture strength by increasing the grain boundary strength. If the amount of boron added is less than 0.001%, the above effects are not discernible. If the amount of boron added exceeds 0.015%, an adverse effect of the deterioration of the hardenability occurs. Accordingly, it has been determined that the permissible boron content is from 0.001 to 0.015%, preferably 0.003 to 0.010%.

Next, an explanation with regard to phosphorus, sulfur, copper, aluminum, arsenic, tin, and antimony, which are harmful impurities, will be given. It goes without saying that the less of these impurities present, the better for the mechanical properties of the steel product. However, elements for which permissible amounts contained as impurities in a steel product have been standardized are only phosphorus and sulfur, which are inevitably transferred from the materials used for steel production. Since phosphorus and sulfur embrittle the steel product, permissible amounts of phosphorus and sulfur are established for most types of steel products, which are at considerably high levels in view of difficulty of the refining processes. As a result of diligent research aimed at improvement of the high-temperature properties of a CrMoV steel for turbine rotors, particularly improvement of the creep rupture strength of a notched test piece, the present inventors have found that trace impurities greatly affect the creep rupture strength of a notched test piece. As such impurities, not only phosphorus and sulfur, but also copper, aluminum, arsenic, tin, antimony, and the like were also found to have harmful effects. Although there has hitherto been the vague notion that the lower the amount of the trace impurities the better, specific permissible amounts have not been clear. The present inventors have studied these impurities in detail, and decided to specifically quantify the permissible amounts in an effort to achieve a rupture time of 10000 hours or longer in a creep test on a notched test piece under the conditions of a temperature of 600° C. and a stress of 147 MPa.

Phosphorus (P) and Sulfur (S): Both phosphorus and sulfur are impurities transferred from materials for steel production, and are harmful impurities which cause noticeable deterioration of the toughness of the steel product by forming a phosphide or a sulfide therein. In the research conducted by the inventors, it was found that phosphorus and sulfur also adversely affect the high-temperature properties. Phosphorus tends to be segregated, and secondarily causes segregation of carbon which embrittles the steel product. It was also found that phosphorus and sulfur greatly affect the embrittlement when a high load is applied at a high temperature over a long time. Since extreme reduction of phosphorus and sulfur is a large burden on the steel production process, the upper limits of phosphorus and sulfur were sought such that the rupture time in a creep test on a notched test piece is 10000 hours or longer. As a result, it has been determined that the upper limit of phosphorus is 0.012%, and the upper limit of sulfur is 0.005%. More preferably, phosphorus is 0.010% or less, and sulfur is 0.002% or less.

Copper (Cu): Copper is diffused along crystal grain boundaries in the steel product, and embrittles the steel product. Copper particularly degrades high-temperature properties. In view of the results of creep rupture tests on notched test pieces, it has been determined that the upper limit of the copper content is 0.15%. More preferably, the copper content is 0.04% or less.

Aluminum (Al): Aluminum is brought into steel mainly from deoxidizers during the steel production process, and forms an oxide-type inclusion in the steel product, which embrittles it. In view of the results of creep tests on notched test pieces, it has been determined that the upper limit of the aluminum content is 0.01%. More preferably, the copper content is 0.005% or less.

Arsenic (As), Tin (Sn), and Antimony (Sb): It is often the case that arsenic, tin, and antimony are brought into the steel from materials for steel production. They are precipitated along crystal grain boundaries, which cause deterioration of the toughness of the steel product. Arsenic, tin, and antimony are aggregated in crystal grain boundaries particularly at high temperatures, and accelerate the embrittlement. In view of the results of creep rupture tests on notched test pieces, the upper limits of these impurities are 0.01% for arsenic, 0.01% for tin, and 0.003% for antimony. More preferably, the arsenic content is 0.007% or less, the tin content is 0.007% or less, and the antimony content is 0.0015% or less.

Next, the process for producing a high pressure and low pressure integrated type turbine rotor of the present invention will be described.

According to the process for producing a high pressure and low pressure integrated type turbine rotor of the present invention, first, as described above, a base material is produced by a melting process so as to have a predetermined alloy composition. A method for reducing the trace impurities is not particularly limited, and various well-known refining methods that include the careful selection of raw materials can be employed.

Then, in the case where a turbine rotor member, for example, is manufactured, an alloy melt with a predetermined composition is cast by a well-known method to form a steel ingot, which is subjected to a predetermined forging/molding process to produce a material for the turbine rotor member.

Subsequently, this material is subjected to heat treatments by dividing it into two sections, i.e., portions corresponding to the high-pressure part and low-pressure part of a turbine rotor. Heat treatment for two sections separately can be achieved by providing a partition having heat resistance in respective spaces for containing the portions in a heat treat furnace to divide the inside of the heat treat furnace into two chambers and controlling the temperature of each chamber independently.

In the heat treat furnace thus constructed, the above turbine rotor member is placed and heated. The part corresponding to the high-pressure part of a turbine rotor is to a temperature of 980° C. or more and 1100° C. or less. This is because the part corresponding to the high-pressure part will have an insufficient high temperature creep strength unless the heating temperature before quenching is 980° C. or more, and will have a decreased toughness if it is heated to a temperature exceeding 1100° C. The part corresponding to the low-pressure part of a turbine rotor is heated to a temperature of 850° C. or more and less than 980° C. This is because the part corresponding to the low-pressure part will have insufficient strength and toughness unless it is heated to a temperature of 850° C. or more since the solid solution formation of carbides does not proceed, and if the heating temperature before quenching is 980° C. or more, coarse crystal grains are formed, which deteriorates the toughness.

In the turbine rotor member heated to the above temperature range, the part corresponding to the high-pressure part of a turbine rotor is cooled at a cooling rate not lower than the air impact cooling rate and the part corresponding to the low-pressure part of a turbine rotor is cooled at a cooling rate not lower than oil quenching. Specifically, to cool the part corresponding to the high-pressure part at a cooling rate not lower than the air impact cooling rate, air impact cooling, oil cooling, water cooling, water spray cooling, or the like can be used. To cool the part corresponding to the low-pressure part at a cooling rate not lower than the oil quenching, oil cooling, water cooling, water spray cooling, or the like can be used. So far as the cooling conditions are satisfied, either an overall quenching treatment in which the entire rotor member is cooled using a cooling method or gradient quenching treatment in which different cooling methods are used for the parts corresponding to the high-pressure and low-pressure parts of a turbine rotor, may be used.

The rotor member subjected to the above quenching treatment is tempered to arrange the crystal structure and adjust the mechanical properties.

Tempering is performed aiming at a 0.2% yield strength of 588 to 686 MPa for the part corresponding to the high-pressure part of a turbine rotor and a 0.2% yield strength of 686 to 784 MPa for the part corresponding to the low-pressure part of a turbine rotor. More particularly, it is preferred that the part corresponding to the high-pressure part be tempered at a temperature of 600 to 750° C. and the part corresponding to the low-pressure part be tempered at a temperature of 550 to 700° C. Furthermore, the tempering treatment is not limited to one per heat treatment; and may be repeated twice or more. By carrying out such a series of heat treatments, a turbine rotor containing predetermined mechanical properties for each part corresponding to the high-pressure part and the low-pressure part can be obtained.

Next, the structure of the high pressure and low pressure integrated type turbine rotor according to the present invention as observed by an optical microscope is described.

The high pressure and low pressure integrated type turbine of the present invention heat-treated as described above mainly has a bainitic structure. The crystal grain size is slightly coarser in the part corresponding to the high-pressure part and the part corresponding to the low-pressure part has a fine structure.

The high-pressure part of the turbine rotor of the present invention is quenched after it is heated to a high temperature of 980° C. or more, so that precipitation of soft pro-eutectoid ferrite phase is inhibited, therefore, it secures high material strength, particularly, excellent toughness, creep rupture strength, and creep embrittlement resistance. However, when the pro-eutectoid ferrite phase precipitated is in a small amount and is finely distributed, the harmful effects are small. If the proportion of the ferrite phase as observed under an optical microscope is no more than 10% by volume in the part corresponding to the high-pressure part and no more than 30% by volume in the part corresponding to the low-pressure part, the ferrite phase does not cause so much adverse effect and the above proportion is an allowable amount.

The proportion of the ferrite phase in the optical microscopic structure can be determined using an image analyzing device which is commonly used.

EXAMPLES

The present invention will be more specifically described with reference to the following examples.

Example 1

In Table 1, the chemical compositions of materials tested in Example 1 (Samples Nos. 1 to 3) and of comparative materials (Samples Nos. 4 to 6) are shown. The amounts of the pro-eutectoid ferrite phase in each material were quantified using an image analyzing device, when each material was cooled under conditions which simulated the central part of an oil-quenched rotor member having a drum diameter of 1200 mm (corresponding to the high-pressure part) after heating to 950° C., 1000° C., and 1050° C. and when each material was cooled under conditions which simulated the central part of an oil-quenched rotor member having a drum diameter of 2000 mm (corresponding to the low-pressure part) after heating to 900° C., and the results are shown in Table 2. In addition, the 0.2% yield strength, the Charpy impact absorbed energy, and the creep rupture time under specific conditions of a temperature of 600° C. and a stress of 147 MPa for notched and unnotched test pieces were measured for each material, and then, the creep embrittlement indexes were calculated according to these measured values of the creep rupture time. The results are shown in Table 3.

Each of Samples Nos. 4 and 5 of Comparative Example exhibits considerable creep embrittlement because of the high content of impurities such as phosphorus, sulfur, copper, aluminum, arsenic, tin, and antimony. Since Sample No. 6 precipitated much pro-eutectoid ferrite, both a 0.2% yield strength and creep strength on an unnotched test piece at the high-pressure part are low and these results shows insufficient strength for a turbine rotor. Also, the low-pressure part has a considerably low strength.

In contrast, in Samples Nos. 1 to 3 for the turbine rotors of the present invention, no precipitation of pro-eutectoid ferrite was observed either in the high-pressure part or the low-pressure part.

Further, in Samples Nos. 1 to 3, the high-pressure part has a 0.2% yield strength of 625 MPa or more and a Charpy impact absorbed energy at room temperature was 32 J or more, therefore, Samples Nos. 1 to 3 have sufficient strength and toughness as a high-pressure part. In a creep rupture test performed under specific conditions of a temperature of 600° C. and a stress of 147 MPa, each material had a creep rupture time of 3000 hours or longer on an unnotched test piece and of 10000 hours or longer on a notched test piece. These results show that the creep rupture strength increased greatly. The creep embrittlement index as expressed by a ratio of a creep rupture time in a creep rupture test on a notched test piece to a creep rupture time in a creep rupture test on an unnotched test piece was 3.1 or more in each case and no creep embrittlement was observed.

The low-pressure part has a 0.2% yield strength of 725 MPa or more and a Charpy impact absorbed energy at room temperature was 160 J or more, therefore, Samples Nos. 1 to 3 also have sufficient strength and toughness as a low-pressure part.

As described above, the high pressure and low pressure integrated type turbine rotor of the present invention has excellent high temperature creep properties at the high-pressure part and excellent strength and toughness simultaneously at the low-pressure part.

Example 2

Next, the chemical compositions of the alloys used in Example 2 are shown in Table 4. In Example 2, alloys prepared by adding tungsten to the alloy in Example 1 as a base material were used.

The alloy of Sample No. 7 is an alloy prepared by adding tungsten to the alloy of Sample No. 1 as a base material, laying importance on the further improvement of high temperature creep properties at the high-pressure part.

The alloy of Sample No. 8 is an alloy prepared by adding tungsten to the alloy of Sample No. 1 as a base material with slightly decreasing the nickel content, laying importance on the further improvement of high temperature creep properties at the high-pressure part.

The alloy of Sample No. 9 is an alloy prepared by adding tungsten to the alloy of Sample No. 2 as a base material with a view to increasing the high temperature creep properties at the high-pressure part with limiting the amount of tungsten to a low level, taking into consideration the balance with the toughness at the low-pressure part.

In Table 5, results of measurements on these materials are shown. More particularly, the amounts of the pro-eutectoid ferrite phase in each material were quantified using an image analyzing device, when each material was cooled under conditions which simulated the central part of an oil-quenched rotor member having a drum diameter of 1200 mm (corresponding to the high-pressure part) after heating to 1050° C. (1000° C. and 1050° C. for the alloy of Sample No. 8) and when each material was cooled under conditions which simulated the central part of an oil-quenched rotor member having a drum diameter of 2000 mm (corresponding to the low-pressure part) after heating to 900° C., and the results are shown together with the results of the 0.2% yield strength, the Charpy impact absorbed energy, and the creep rupture time under specific conditions of a temperature of 600° C. and a stress of 147 MPa for each material measured for notched and unnotched test pieces, and then, the creep embrittlement indexes were calculated according to these measured values of the creep rupture time are also shown.

According to the results shown in Table 5, no pro-eutectoid ferrite phase was observed in the high-pressure part in Samples Nos. 7 and 9 and the high-pressure part had a yield of 0.2% yield strength of 634 MPa or more and a Charpy impact absorbed energy at room temperature of 32 J or more, and these results show sufficient strength and toughness as a high-pressure part. In a creep rupture test performed under specific conditions of a temperature of 600° C. and a stress of 147 MPa, each material had a creep rupture time of 4200 hours or longer on an unnotched test piece and of 14000 hours or longer on a notched test piece, which indicted that the creep rupture strength increased greatly. The creep embrittlement index as expressed by a ratio of a creep rupture time in a creep rupture test on a notched test piece to a creep rupture time in a creep rupture test on an unnotched test piece was 3.0 or more in each case, and no creep embrittlement was observed.

The low-pressure part had a 0.2% yield strength of 720 MPa or more and a Charpy impact absorbed energy at room temperature of 133 J or more, and these results show sufficient strength and toughness as a low-pressure part.

As described above, the high pressure and low pressure integrated type turbine rotor of the present invention has an excellent high temperature creep properties at the high-pressure part, and excellent strength and toughness simultaneously at the low-pressure part.

Figure 2:
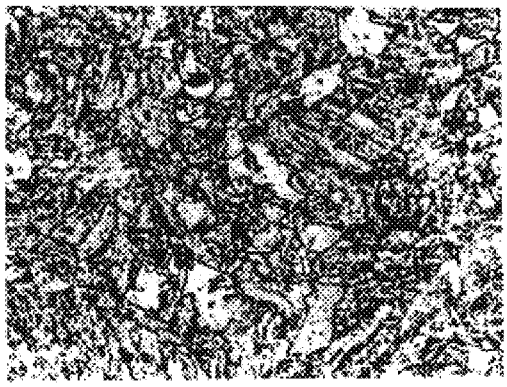
FIG. 2 is a diagram showing the structure observed using an optical microscope of an example of an alloy of the present invention when quenched after heated at 950° C.
Figure 3:
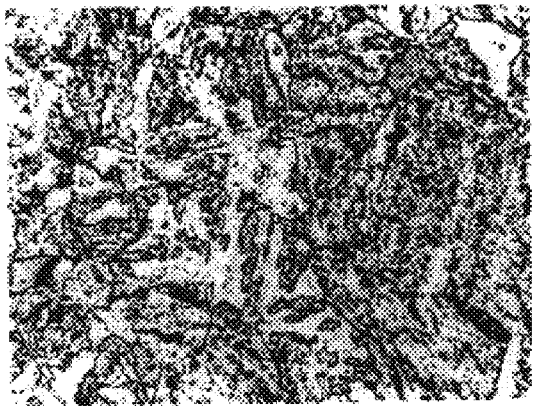
FIG. 3 is a diagram showing the structure observed using an optical microscope of an example of an alloy of the present invention when quenched after heated at 1,000° C.
Figure 4:
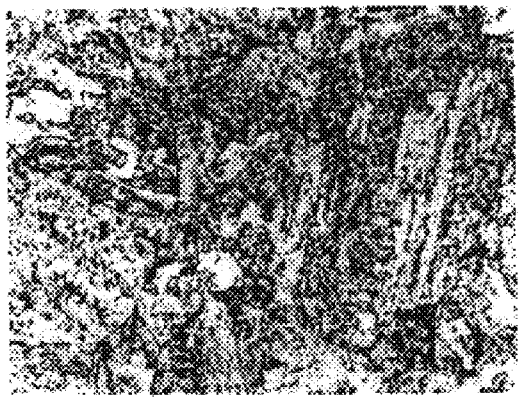
FIG. 4 is a diagram showing the structure observed using an optical microscope of an example of an alloy of the present invention when quenched after heated at 1,050° C.

Here, optical microphotographs of the structures of the alloy of Sample No. 8 are shown in FIGS. 1 and 2, wherein the alloy was cooled under conditions which simulated the central part of an oil-quenched rotor member having a drum diameter of 2000 mm (corresponding to the low-pressure part) after heating to (a) 900° C. and (b) 950° C. Also, optical microphotographs of the structures of the alloy of Sample No. 8 are shown in FIGS. 3 and 4, wherein the alloy was cooled under conditions which simulated the central part of an oil-quenched rotor member having a drum diameter of 1200 mm (corresponding to the high-pressure part) after heating to (c) 1000° C. and (d) 1050° C. In each case, magnification was 400 fold.

The amount of the pro-eutectoid ferrite was (a) 24% by volume in the case of the quenching after heating to 900° C. and (b) 12% by volume in the case of the quenching after heating to 950° C., (c) 4% by volume in the case of the quenching after heating to 1000° C., and 0% by volume in the case of the quenching after heating to 1050° C., indicating that the amount of the pro-eutectoid ferrite decreases as temperature increases.

In the case of (a) quenching after heating to 900° C. and (b) quenching after heating to 950° C. corresponding to the low-pressure part of a turbine rotor, the pro-eutectoid ferrite precipitated in higher amounts of 24% by volume and 12% by volume, respectively. However, as shown in Table 5, both of the 0.2% yield strength and Charpy impact absorbed energy are high, so it can be seen that the rotor has sufficient toughness. From this it follows that in the present invention, it is allowed that the low-pressure part contains up to 30% by volume of pro-eutectoid ferrite. In the case of (c) quenching after heating to 1000° C. and (d) quenching after heating to 1050° C. corresponding to the high-pressure part of a turbine rotor, the pro-eutectoid ferrite precipitated in small amounts of 4% by volume and 0% by volume, respectively. In the case of quenching after heating to 1000° C., the rotor member contained a small amount of pro-eutectoid ferrite. However, as shown in Table 5, it exhibits excellent values of creep rupture time that are higher than that of the alloy of Sample No. 1 used as a base material either on an unnotched test piece or on a notched test piece, and it also exhibits good results in 0.2% yield strength and Charpy impact absorbed energy at room temperature, indicating that there are no problems in using the material as a high-pressure rotor member. From this it follows that in the present invention, it is allowed that the high-pressure part contain up to 10% by volume of pro-eutectoid ferrite.

In the case of the member quenched after heating it to 1050° C., high temperature creep rupture properties further improve , and its 0.2% yield strength and Charpy impact absorbed energy at room temperature are good, so that it is apparent that it is excellent as a high-pressure rotor member.

In other examples of the present invention, most alloys are of a bainitic structure containing no pro-eutectoid ferrite phase, and shows structures as observed using microscope similar to that shown in FIG. 4. In the case where pro-eutectoid ferrite was contained, the structure as observed using microscope was similar in shape to those shown in FIGS. 1 to 3.

Example 3

The chemical compositions of the alloys used in Example 3 are shown in Table 6.

The alloy of Sample No. 11 is an alloy prepared by adding cobalt to the alloy of Sample No. 1 as a base material with decreasing the amount of nickel in order to improve creep properties in the high-pressure part while maintaining the toughness in the low-pressure part to an equivalent level or higher.

The alloy of Sample No. 12 is an alloy prepared by adding cobalt to the alloy of Sample No. 8 as a base material while decreasing the amount of nickel in order to improve creep properties in the high-pressure part and maintaining the toughness in the low-pressure part to an equivalent level or higher.

The alloy of Sample No. 13 is an alloy prepared by adding cobalt to the alloy of Sample No. 9 as a base material while decreasing the amount of nickel in order to improve creep properties in the high-pressure part and maintaining the toughness in the low-pressure part to an equivalent level or higher.

In Table 7, results of measurements on these materials are shown. More particularly, the amounts of the pro-eutectoid ferrite phase in each material were quantified using an image analyzing device, when each material was cooled under conditions which simulated the central part of an oil-quenched rotor member having a drum diameter of 1200 mm (corresponding to the high-pressure part) after heating to 1050° C. and when each material was cooled under conditions which simulated the central part of an oil-quenched rotor member having a drum diameter of 2000 mm (corresponding to the low-pressure part) after heating to 900° C., and the results are shown together with the results of the 0.2% yield strength, the Charpy impact absorbed energy, and the creep rupture time under specific conditions of a temperature of 600° C. and a stress of 147 MPa for each material measured for notched and unnotched test pieces, and then, the creep embrittlement indexes were calculated according to these measured values of the creep rupture time are also shown.

According to the results in Table 7, in the high-pressure part in Samples Nos. 11, 12 and 13, no pro-eutectoid ferrite phase was observed and a 0.2% yield strength is 626 MPa or more and a Charpy impact absorbed energy at room temperature is 41 J or more, so that the high-pressure part has sufficient strength and toughness. In a creep rupture test performed under specific conditions of a temperature of 600° C. and a stress of 147 MPa, each material had a creep rupture time of 5200 hours or longer on an unnotched test piece and of 16000 hours or longer on a notched test piece, which indicates that the creep rupture strength increased greatly. The creep embrittlement index as expressed by a ratio of a creep rupture time in a creep rupture test on a notched test piece to a creep rupture time in a creep rupture test on an unnotched test piece was 2.5 or more in each case, and no creep embrittlement was observed.

The low-pressure part had a 0.2% yield strength of 730 MPa or more and a Charpy impact absorbed energy at room temperature of 186 J or more, and it was observed that it had sufficient strength and toughness as a high-pressure part.

In the low-pressure part of Sample No. 13, although 12% by volume of pro-eutectoid ferrite phase was observed, it had a 0.2% yield strength of 735 MPa or more and a Charpy impact absorbed energy at room temperature of 186 J or more, indicating that it had excellent high temperature creep properties at the high-pressure part, and excellent strength and toughness simultaneously at the low-pressure part.

As described above, the high pressure and low pressure integrated type turbine rotor of the present invention has an excellent high temperature creep properties at the high-pressure part, and excellent strength and toughness simultaneously at the low-pressure part.

Example 4

The chemical compositions of the alloys used in Example 4 are shown in Table 8.

The alloy of Sample No. 16 is an alloy prepared by adding trace useful elements, such as tantalum, nitrogen, and boron, to the alloy of Sample No. 9 as a base material in order to improve creep properties of the high-pressure part.

In Table 9, results of measurements on these materials are shown. More particularly, the amounts of the pro-eutectoid ferrite phase in each material were quantified using an image analyzing device, when each material was cooled under conditions which simulated the central part of an oil-quenched rotor member having a drum diameter of 1200 mm (corresponding to the high-pressure part) after heating to 1050° C. and when each material was cooled under conditions which simulated the central part of an oil-quenched rotor member having a drum diameter of 2000 mm (corresponding to the low-pressure part) after heating to 900° C., and the results are shown together with the results of the 0.2% yield strength, the Charpy impact absorbed energy, and the creep rupture time at 600° C. and a stress of 147 MPa for each material measured for notched and unnotched test pieces, and then, the creep embrittlement indexes were calculated according to these measured values of the creep rupture time are also shown.

According to the results in Table 9, in the high-pressure part in Sample No. 16, no pro-eutectoid ferrite phase was observed and a 0.2% yield strength is 635 MPa or more and a Charpy impact absorbed energy at room temperature is 31 J or more, so that the high-pressure part has sufficient strength and toughness as a high-pressure part. In a creep rupture test performed under specific conditions of a temperature of 600° C. and a stress of 147 MPa, each material had a creep rupture time of 5000 hours or longer on an unnotched test piece, and of 15000 hours or longer on a notched test piece, which indicated that the creep rupture strength increased greatly. The creep embrittlement index as expressed by a ratio of a creep rupture time in a creep rupture test on a notched test piece to a creep rupture time in a creep rupture test on an unnotched test piece was 2.1 or more in each case and no creep embrittlement was observed.

The low-pressure part had a 0.2% yield strength of 720 MPa or more and a Charpy impact absorbed energy at room temperature of 169 J or more, and it was observed that it had sufficient strength and toughness as a high-pressure part.

As described above, the high pressure and low pressure integrated type turbine rotor of the present invention has an excellent high temperature creep properties at the high-pressure part, and excellent strength and toughness simultaneously at the low-pressure part.

TABLE 1

| | Example 1 | | | Comparative Example | | |
|---|---|---|---|---|---|---|
| Sample No. | 1 | 2 | 3 | 4 | 5 | 6 |
| Chemical Composition (wt %) | | | | | | |
| C | 0.24 | 0.25 | 0.30 | 0.29 | 0.25 | 0.16 |
| Si | 0.06 | 0.03 | 0.04 | 0.35 | 0.04 | 0.04 |
| Mn | 0.78 | 0.70 | 0.18 | 0.84 | 0.79 | 0.18 |
| Ni | 0.85 | 1.39 | 0.53 | 0.45 | 0.25 | 0.15 |
| Cr | 2.23 | 2.30 | 2.47 | 1.01 | 2.24 | 3.47 |
| Mo | 1.15 | 1.04 | 1.29 | 1.15 | 1.20 | 1.13 |
| W | — | — | — | — | — | — |
| V | 0.24 | 0.25 | 0.26 | 0.28 | 0.22 | 0.18 |
| Nb | — | — | — | — | — | — |
| Ta | — | — | — | — | — | — |
| Ti | — | — | — | — | — | — |
| Co | — | — | — | — | — | — |
| N | — | — | — | — | — | — |
| O | — | — | — | — | — | — |
| B | — | — | — | — | — | — |
| Fe | balance | balance | balance | balance | balance | balance |
| P | 0.006 | 0.003 | 0.007 | 0.014 | 0.015 | 0.007 |
| S | 0.001 | 0.002 | 0.001 | 0.013 | 0.009 | 0.002 |
| Cu | 0.04 | 0.03 | 0.03 | 0.16 | 0.12 | 0.04 |
| Al | 0.004 | 0.003 | 0.002 | 0.007 | 0.011 | 0.003 |
| As | 0.005 | 0.004 | 0.003 | 0.025 | 0.026 | 0.005 |
| Sn | 0.004 | 0.004 | 0.004 | 0.024 | 0.030 | 0.005 |
| Sb | 0.0009 | 0.0011 | 0.0010 | 0.0033 | 0.0056 | 0.0010 |

TABLE 2

| | Amount of pro-eutectoid ferrite (volume %) Heating temperature before quenching (° C.) | | | | |
|---|---|---|---|---|---|
| Sample | High-pressure part | | | Low-pressure part | |
| No. | 950 | 1000 | 1050 | 900 | Note |
| Example 1 | | | | | |
| 1 | 0 | 0 | 0 | 0 | |
| 2 | 0 | 0 | 0 | 0 | |
| 3 | 0 | 0 | 0 | 0 | |
| Comparative Example | | | | | |
| 4 | 0 | 0 | 0 | 0 | |
| 5 | 0 | 0 | 0 | 0 | |
| 6 | 32 | 13 | 0 | 35 | Insufficient strength |

TABLE 3

| Sample No. | Pressure part | Heating temperature before quenching (° C.) | 0.2% Yield (MPa) | Charpy impact absorbed energy (J) | 600° C.-147 MPa Creep rupture time (h) Unnotched test piece | Notched test piece | Creep embrittlement index (notched/unnotched) | Note |
|---|---|---|---|---|---|---|---|---|
| Example 1 | | | | | | | | |
| 1 | High | 950 | 644 | 53 | 2330 | 7621 | 3.27 | Comparative example |
| | | 1000 | 632 | 46 | 3210 | 10564 | 3.29 | Sufficient creep rupture strength |
| | | 1050 | 625 | 36 | 3854 | Not broken in 12000 | No less than 3.11 | at high-pressure part |
| | Low | 900 | 725 | 181 | — | — | — | |
| 2 | High | 950 | 634 | 60 | 2292 | 6588 | 2.87 | Comparative example |
| | | 1000 | 646 | 54 | 3124 | 10130 | 3.24 | Sufficient creep rupture strength |
| | | 1050 | 644 | 48 | 3437 | 11763 | 3.42 | at high-pressure part |
| | Low | 900 | 735 | 200 | — | — | — | |
| 3 | High | 950 | 630 | 41 | 2583 | 8660 | 3.35 | Comparative example |
| | | 1000 | 637 | 37 | 3155 | 10969 | 3.48 | Sufficient creep rupture strength |
| | | 1050 | 638 | 32 | 3681 | Not broken in 12000 | No less than 3.26 | at high-pressure part |
| | Low | 900 | 728 | 160 | — | — | — | |
| Comparative Example | | | | | | | | |
| 4 | High | 950 | 635 | 32 | 2570 | 6584 | 2.56 | Considerable creep embrittlement |
| | | 1000 | 636 | 33 | 3068 | 4025 | 1.13 | at high-pressure part |
| | | 1050 | 643 | 24 | 3736 | 3119 | 0.83 | |
| | Low | 900 | 723 | 148 | — | — | — | |
| 5 | High | 950 | 626 | 48 | 2504 | 6411 | 2.56 | Considerable creep embrittlement |
| | | 1000 | 644 | 41 | 2993 | 4557 | 1.52 | at high-pressure part |
| | | 1050 | 643 | 31 | 4063 | 3340 | 0.82 | |
| | Low | 900 | 731 | 118 | — | — | — | |
| 6 | High | 950 | 531 | 67 | 1030 | Not broken in 5000 | No less than 4.85 | Insufficient strength even after |
| | | 1000 | 537 | 58 | 1206 | Not broken in 5000 | No less than 4.15 | tempering at 600° C. |
| | | 1050 | 548 | 50 | 1354 | Not broken in 5000 | No less than 3.69 | (high-pressure part) |
| | Low | 900 | 649 | 208 | — | — | — | Insufficient creep strength on notched test piece Insufficient strength even after tempering at 550° C. (low-pressure part) |

TABLE 4

| Sample No. | Example 2 7 | 8 | 9 |
|---|---|---|---|
| Chemical Composition (wt %) | | | |
| C | 0.24 | 0.25 | 0.25 |
| Si | 0.05 | 0.05 | 0.04 |
| Mn | 0.79 | 0.82 | 0.74 |
| Ni | 0.83 | 0.35 | 1.45 |
| Cr | 2.24 | 2.25 | 2.29 |
| Mo | 1.12 | 1.10 | 1.00 |
| W | 2.48 | 2.26 | 1.04 |
| V | 0.23 | 0.23 | 0.25 |
| Nb | — | — | — |
| Ta | — | — | — |
| Ti | — | — | — |
| Co | — | — | — |

TABLE 4-continued

| Sample No. | Example 2 7 | 8 | 9 |
|---|---|---|---|
| N | — | — | — |
| O | — | — | — |
| B | — | — | — |
| Fe | Balance | Balance | Balance |
| P | 0.006 | 0.005 | 0.005 |
| S | 0.001 | 0.001 | 0.002 |
| Cu | 0.04 | 0.04 | 0.03 |
| Al | 0.004 | 0.003 | 0.002 |
| As | 0.004 | 0.004 | 0.004 |
| Sn | 0.005 | 0.005 | 0.004 |
| Sb | 0.0009 | 0.0010 | 0.0011 |

TABLE 5

| Sample No. | Pressure part | Heating temperature before quenching (° C.) | Amount of pro-eutectoid ferrite (volume %) | 0.2% yield (MPa) | Charpy impact absorbed energy (J) | 600° C.-147 MPa Creep rupture time (h) Unnotched test piece | Notched test piece | Creep embrittlement index (notched/unnotched) | Note |
|---|---|---|---|---|---|---|---|---|---|
| Example 2 | | | | | | | | | |
| 7 | High | 1050 | 0 | 634 | 32 | 4962 | 15365 | 3.10 | Sufficient creep rupture strength |
| | Low | 900 | 8 | 735 | 141 | — | — | — | at high-pressure part (HP type) |
| 8 | High | 1000 | 4 | 630 | 37 | 4711 | 14503 | 3.08 | Sufficient creep rupture strength |
| | | 1050 | 0 | 636 | 29 | 5834 | 17806 | 3.05 | at high-pressure part (HP type) |
| | Low | 900 | 24 | 720 | 133 | — | — | — | |
| 9 | High | 1050 | 0 | 637 | 47 | 4260 | 14368 | 3.37 | Sufficient toughness at |
| | Low | 900 | 0 | 737 | 189 | — | — | — | low-pressure part (LP type) |

TABLE 6

| Sample No. | Example 3 11 | 12 | 13 |
|---|---|---|---|
| Chemical Composition (wt %) | | | |
| C | 0.25 | 0.25 | 0.26 |
| Si | 0.05 | 0.06 | 0.05 |
| Mn | 0.77 | 0.80 | 0.77 |
| Ni | 0.39 | 0.34 | 0.40 |
| Cr | 2.24 | 2.25 | 2.28 |
| Mo | 1.15 | 1.12 | 1.03 |
| W | — | 2.24 | 1.06 |
| V | 0.24 | 0.24 | 0.24 |
| Nb | — | — | — |
| Ta | — | — | — |
| Ti | — | — | — |
| Co | 1.01 | 1.52 | 1.95 |
| N | — | — | — |
| O | — | — | — |
| B | — | — | — |
| Fe | balance | balance | balance |
| P | 0.005 | 0.005 | 0.004 |
| S | 0.001 | 0.001 | 0.002 |
| Cu | 0.03 | 0.05 | 0.03 |
| Al | 0.004 | 0.003 | 0.002 |
| As | 0.004 | 0.005 | 0.005 |
| Sn | 0.005 | 0.005 | 0.004 |
| Sb | 0.0011 | 0.0011 | 0.0009 |

TABLE 8

| Sample No. | Example 4 16 |
|---|---|
| Chemical Composition (wt %) | |
| C | 0.26 |
| Si | 0.05 |
| Mn | 0.75 |
| Ni | 1.43 |
| Cr | 2.27 |
| Mo | 0.99 |
| W | 0.98 |
| V | 0.21 |
| Nb | — |
| Ta | 0.08 |
| Ti | — |
| Co | — |
| N | — |
| O | — |
| B | 0.0045 |
| Fe | Balance |
| P | 0.005 |
| S | 0.001 |
| Cu | 0.03 |
| Al | 0.002 |
| As | 0.005 |
| Sn | 0.005 |
| Sb | 0.0009 |

TABLE 7

| Sample No. | Pressure part | Heating temperature before quenching (° C.) | Amount of pro-eutectoid ferrite (volume %) | 0.2% Yield (MPa) | Charpy impact absorbed energy (J) | 600° C.-147 MPa Creep rupture time (h) Unnotched test piece | Notched test piece | Creep embrittlement index (notched/unnotched) | Note |
|---|---|---|---|---|---|---|---|---|---|
| Example 3 | | | | | | | | | |
| 11 | High | 1050 | 0 | 630 | 41 | 5218 | 16941 | 3.25 | Sufficient creep |
| | Low | 900 | 0 | 735 | 199 | — | — | — | rupture strength at high-pressure part |
| 12 | High | 1050 | 0 | 638 | 45 | 7133 | Not broken in 18000 | No less than 2.52 | Sufficient creep |
| | Low | 900 | 0 | 730 | 188 | — | — | — | rupture strength at high-pressure part |
| 13 | High | 1050 | 0 | 626 | 46 | 5930 | Not broken in 18000 | No less than 3.04 | Sufficient creep |
| | Low | 900 | 12 | 735 | 186 | — | — | — | rupture strength at high-pressure part |

TABLE 9

| Sample No. | Pressure part | Heating temperature before quenching (° C.) | Amount of pro-eutectoid ferrite (volume %) | 0.2% yield (MPa) | Charpy impact absorbed energy (J) | 600° C.-147 MPa Creep rupture time (h) Unnotched text piece | Notched test piece | Creep embrittlement index (notched/unnotched) | Note |
|---|---|---|---|---|---|---|---|---|---|
| Example 4 | | | | | | | | | |
| 16 | High | 1050 | 0 | 637 | 47 | 5102 | 15582 | 3.05 | Sufficient creep rupture strength |
| | Low | 900 | 0 | 737 | 196 | — | — | — | at high-pressure part |

What is claimed is:

1. A process for producing a high pressure and low pressure integrated turbine rotor comprising the steps of:

heating a part corresponding to the high-pressure part of a turbine rotor member at a temperature of 980° C. or more and 1100° C. or less and a part corresponding to a low-pressure part of a turbine rotor member at a temperature of 850° C. or more and less than 980° C., and cooling the part corresponding to a high-pressure part of the turbine rotor member at a cooling rate higher than an air impact cooling rate and the part corresponding to the low-pressure part of the turbine rotor member at a cooling rate no lower than an oil quenching rate.

2. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, vanadium in an amount of 0.1 to 0.3% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

3. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

4. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an a mount of 1.0 to 3.0% by weight, molybdenum in an amount of 0.5 to 1.5% by weight, vanadium in an amount of 0.1to 0.3% by weight, cobalt in an amount of 0.1to 3.0% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

5. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, cobalt in an amount of 0.1 to 3.0% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

6. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, vanadium in an amount of 0.1 to 0.3% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

7. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

8. The process for producing a high pressure and low pressure integrated turbine as claimed in claim 1, wherein the turbine rotor member comprises an alloy steel comprising:

carbon in an amount of 0.20 to 0.35% by weight, silicon in an amount of 0.15% by weight or less, manganese in an amount of 0.05 to 1.0% by weight, nickel in an amount of 0.3 to 1.5% by weight, chromium in an amount of 1.0 to 3.0% by weight, molybdenum in an amount of 0.5 to 1.5% by weight, tungsten in an amount of 0.1 to 3.0% by weight, vanadium in an amount of 0.1 to 0.3% by weight, cobalt in an amount of 0.1 to 3.0% by weight, at least one selected from the group consisting of tantalum in an amount of 0.01 to 0.15% by weight, nitrogen in an amount of 0.001 to 0.05% by weight, and boron in an amount of 0.001 to 0.015% by weight, phosphorus in an amount not larger than 0.012% by weight or substantially no phosphorus, sulfur in an amount not larger than 0.005% by weight or substantially no sulfur, copper in an amount not larger than 0.15% by weight or substantially no copper, aluminum in an amount not larger than 0.01% by weight or substantially no aluminum, arsenic in an amount not larger than 0.01% by weight or substantially no arsenic, tin in an amount not larger than 0.01% by weight or substantially no tin, and antimony in an amount not larger than 0.003% by weight or substantially no antimony, the balance being iron and unavoidable impurities.

* * * * *